US006783631B2

(12) United States Patent
Schulz

(10) Patent No.: US 6,783,631 B2
(45) Date of Patent: Aug. 31, 2004

(54) DECORATIVE PAPER WITH A HIGH OPACITY

(75) Inventor: Hartmut Schulz, Wallenhorst (DE)

(73) Assignee: Technocell Dekor GmbH & Co. KG (DE)

( * ) Notice: Subject to any disclaimer, the term of this patent is extended or adjusted under 35 U.S.C. 154(b) by 0 days.

(21) Appl. No.: 10/006,318

(22) Filed: Nov. 13, 2001

(65) Prior Publication Data

US 2003/0089476 A1 May 15, 2003

(30) Foreign Application Priority Data

Nov. 17, 2000 (DE) ..... 100 57 294

(51) Int. Cl.[7] ..... D21H 17/67

(52) U.S. Cl. ..... 162/181.1; 162/181.4; 162/181.5; 162/181.6

(58) Field of Search ..... 162/181.5, 181.4, 162/181.6, 181.1; 106/469

(56) References Cited

U.S. PATENT DOCUMENTS

| | | | | |
|---|---|---|---|---|
| 3,546,066 A | * | 12/1970 | Ware et al. | 162/181.5 |
| 4,028,173 A | * | 6/1977 | Olson | 162/183 |
| 5,817,427 A | * | 10/1998 | Ishida et al. | 162/181.5 |

FOREIGN PATENT DOCUMENTS

| | | | |
|---|---|---|---|
| DE | 197 28 796 | A1 | 1/1999 |
| DE | 199 12 149 | A1 | 9/2000 |
| EP | 0 558 324 | A | 9/1993 |
| EP | 0 930 345 | A2 | 7/1999 |
| JP | 02 265679 | A | 10/1990 |
| JP | 09 262933 | A | 10/1997 |

OTHER PUBLICATIONS

Casey, Pulp and Paper, 3rd ed., vol. III, (1981) pp1603, 1604.*

Notice of Opposition by Papierfabrik August Kohler AG against German Patent Application No. 100 57 294.4 (with English translation).

Ray Counter, "How $TiO_2$ extenders affect opacity and printing properties", Pulp & Paper Canada, vol. 76, No. 9, Sep. 1975, pp 124–127.

Data Sheet about commercially available talc product SMT–3U.

* cited by examiner

*Primary Examiner*—Peter Chin
(74) *Attorney, Agent, or Firm*—Cook, Alex, McFarron, Manzo, Cummings & Mehler, Ltd.

(57) ABSTRACT

A decorative base paper for decorative coating materials contains a pigment mixture of titanium dioxide and talc, wherein the talc has a particle size distribution D50 of less than approximately 3.0 $\mu$m, and both the decorative base paper and the decorative paper have a high capacity.

5 Claims, No Drawings

DECORATIVE PAPER WITH A HIGH OPACITY

BACKGROUND OF THE INVENTION

This invention relates to a decorative paper which contains a pigment mixture of titanium dioxide and talc and the decorative coating materials obtained therefrom.

Decorative coating materials, so-called decorative sheets or decorative paper [paper impregnated with synthetic resin] is preferably used for surface coating in production of furniture and in completion of interiors. Decorative sheets are understood to be printed or unprinted sheets of paper impregnated with a synthetic resin and optionally treated at the surface. Decorative sheets are glued or bonded to a backing board.

Depending on the type of impregnation process, a distinction is made between decorative sheets with a thoroughly impregnated paper core and decorative sheets based on a preimpregnate, in which the paper is impregnated only partially online in the papermaking machine. Molded laminated materials (high-pressure laminates) are laminates produced by pressing several impregnated layered papers. The structure of these molded laminated materials consists in general of a transparent layer (overlay) which produces an extremely high surface stability, a decorative paper impregnated with a synthetic resin and one or more kraft papers impregnated with a phenolic resin. Molded fiber board and particle board as well as plywood can be used as the substrate for this.

In the laminates (low-pressure laminates) produced by the short-cycle method, the decorative paper impregnated with synthetic resin is pressed directly with a substrate, e.g., a particle board using a low pressure. The decorative paper used in the coating materials mentioned above is white or colored and may be with or without an additional imprint.

Special requirements are made of so-called decorative base paper such as high opacity for a better coverage of the substrate, uniform formation and grammage of the sheet for uniform resin uptake, high light stability, high purity and uniformity of the color for good reproducibility of the pattern to be printed, high wet strength for a smooth impregnation operation, suitable absorbency to achieve the required degree of resin saturation and dry strength which are important in re-rolling operations in the papermaking machine and in printing in the printing machine.

Decorative base paper is generally made of high-white sulfate pulp, mainly from hardwood pulp, up to 45% pigments and fillers and wet strength, retention agents and fixing agents. Decorative base paper differs from the usual paper in that it has a much higher filler content and there is none of the internal sizing or surface sizing which is usual in paper with the known sizing agents such as alkyl ketene dimers.

Opacity is one of the most important properties of decorative base paper. This characterizes the coverage with respect to the substrate.

A high opacity of the decorative base paper is also achieved by adding white pigments. Titanium dioxide is usually used as the white pigment. This pigment guarantees a high opacity and a good brightness and whiteness of the decorative base paper. However, the high price of titanium dioxide is a disadvantage.

Replacing some or all of the titanium dioxide with other white pigments has a negative effect on these properties.

Matching of opacity can be achieved only by increasing the pigment content. However, the pigment content cannot be increased to an unlimited extent, because in this case, negative effects on the physical properties such as retention of the pulp suspension, strength, light-fastness and resin uptake can be expected.

SUMMARY OF THE INVENTION

The object of this invention is to make available an inexpensive decorative paper with a high opacity while at the same time having a reduced titanium dioxide content.

This object is achieved by a decorative base paper for decorative coating materials, wherein said decorative base paper contains a pigment mixture of a titanium dioxide and talc. The talc used according to this invention has a very narrow particle size distribution with a D50 of less than about 3 $\mu$m. This means that 50 wt % of the talc particles have a diameter of less than about 3 $\mu$m. Talc with a particle size distribution D50 of less than about 2 $\mu$m is especially preferred.

According to a further embodiment a decorative paper or decorative sheet is provided that includes the aforementioned decorative base paper.

DETAILED DESCRIPTION OF THE PREFERRED EMBODIMENTS

The specific surface area of the talc used according to this invention is greater than about 30,000 $m^2$/kg, or according to an especially preferred embodiment it is greater than about 40,000 $m^2$/kg. On the other hand, the specific surface area of traditional types of talc is in the range of 8,000 to 16,000 $m^2$/kg. The specific surface area was determined according to DIN 66,126.

The amount of talc in the pigment mixture is preferably 0.1 to 25 wt %, based on the total pigment content.

The titanium dioxide preset in the pigment mixture used in the decorative base paper according to this invention may be a titanium dioxide conventionally used in decorative paper. Such titanium dioxides are available commercially and may be used in the rutile or anatase modification. Such titanium dioxides of the rutile type are especially preferred.

Other fillers such as zinc sulfide, calcium carbonate, kaolin or mixtures thereof may be used.

The amount of filler in the decorative base paper may be up to 55 wt %, in particular 11 to 50 wt % or 20 to 45 wt %, based on the weight of the paper. The weight of the decorative base paper according to this invention may be in the range of 30 to 300 g/$m^2$ and is usually 40 to 200 g/$m^2$. The weight is selected as a function of the specific application.

Softwood pulp (long-fiber pulp) or hardwood pulp (short-fiber pulp) may be used as the cellulose pulp for producing the decorative bulk paper according to this invention. It is also possible to use cotton fibers or mixtures of the types of cellulose mentioned above. For example, a mixture of softwood pulp and hardwood pulp in a ratio of 10:90 to 90:10 or mixtures of softwood pulp and hardwood pulp in a ratio of 30:70 to 70:30 are especially preferred. The pulp may have a degree of beating of 20 to 60 SR according to Schopper-Riegler.

The cellulose pulp mixture preferably has a cationically modified cellulose fiber content of at least 5 wt %, based on the weight of the cellulose mixture. A content of 10 to 50 wt %, in particular 10 to 20 wt % of the cationically modified cellulose in the cellulose pulp mixture has proven to be especially advantageous.

Cationically modified cellulose pulps are known from the journal *Das Papier*, volume 12 (1980), pp. 575–579, for example.

In a special embodiment of this invention, the cationically modified cellulose contained in the paper pulp has an effective cationic charge of 20 to 300 mmol/kg pulp, determined according to the internal method no. 4 of the Technical University of Darmstadt. Cellulose pulp fibers with a charge density of 30 to 100 mmol/kg are preferred. The term "effective cationic charge" is understood to refer to a charge density which has been balanced with the charge density of the non-cationized cellulose pulp. The charge density of the cellulose pulp depends on the amount of cationic agent to be used. The amount of cationizing agent may be 0.005 to 200 g/kg cellulose pulp.

The cationic modification of the cellulose pulp fibers may be accomplished through reaction of the fibers with epichlorohydrin resin and a tertiary amine or by reaction with quaternary ammonium chlorides such as chlorohydroxypropyl-trimethyl-ammonium chloride or glycidyltrimethyl-ammonium chloride.

In a preferred embodiment of this invention, cellulose pulp fibers that have been cationically modified by an addition reaction of quaternary ammonium compounds having glycidyl functional groups with hydroxyl groups of cellulose are used.

The decorative bulk paper according to this invention may contain wet strength agents such as polyamide/polyamine-epichlorohydrin resin, other polyamine derivatives or polyamide derivatives, cationic polyacrylates, modified melamine-formaldehyde resin or cationized starches. These are added to the pulp suspension. Likewise, it is also possible to add retention aids and other substances such as organic and inorganic colored pigments, dyes, optical brighteners and dispersants.

The decorative bulk paper according to this invention can be produced on a Fourdrinier papermaking machine or a Yankee papermaking machine. To do so, the cellulose pulp mixture may be pulped to a degree of beating of 30 to 45 SR at a pulp density of 2 to 4 wt %. In a mixing vat, fillers such as titanium dioxide and talc, and wet strength agents are added and mixed well with the cellulose pulp mixture. The resulting thick pulp is diluted to a pulp density of approximately 1 wt %, and other additives such as retention aids, foam suppressant, aluminum sulfate and other additives as listed above are added as needed. This thin pulp is passed through the headbox of the papermaking machine and sent to the wire section. A fiber nonwoven is formed, yielding after drainage the decorative base paper which is then dried.

To produce decorative paper, the decorative base paper is impregnated with the conventional synthetic resin dispersions for this purpose. The conventional synthetic resin dispersions for this purpose include, for example, those based on polyacryl or polyacrylmethyl esters polyvinyl acetate, polyvinyl chloride or synthetic resin solutions based on phenol-formaldehyde precondensates, urea-formaldehyde precondensates or melamine-formaldehyde precondensates or their compatible mixtures.

The impregnation may also be accomplished in the size press of the papermaking machine. The decorative base paper can be impregnated in such a way that the paper is not completely impregnated. Such decorative paper is also known as a preimpregnate. The amount of resin introduced into the decorative base paper by impregnation in this case amounts to 25 to 30 wt %, based on the weight of the paper.

After drying, the impregnated paper can also be coated and printed and then applied to a substrate such as a wooden board. The coated and optionally printed products are generally known as decorative sheets.

The following examples are presented to further illustrate this invention. Amounts given in percent by weight are based on the weight of the cellulose pulp, unless otherwise indicated.

EXAMPLE 1

A cellulose pulp mixture consisting of 70 wt % eucalyptus pulp and 30 wt % softwood sulfate pulp was mixed with 0.6 wt % epichlorohydrin resin as the wet strength agent, 0.11 wt % of a retention aid and 0.03 wt % of a foam suppressant as the basic mixture. The latter three percentages are based on the weight of the pulp. The pH of this mixture was adjusted to 6.5 with aluminum sulfate. This mixture was then mixed with a pigment mixture of 55.8 wt % titanium dioxide and 5.2 wt % talc. Using a Fourdrinier papermaking machine, a decorative paper with a grammage of 105 g/m$^2$ was produced. The titanium dioxide content was 33.5 g/m$^2$ (31.9 wt %) and the talc content was 3.1 g/m$^2$ (2.95 wt %). The talc had a particle size distribution D50 of 1.9 $\mu$m and a specific surface area of 44,300 m$^2$/kg.

EXAMPLE 2

A pigment mixture of 50.3 wt % titanium dioxide and 14.7 wt % talc was added to the basic mixture from Example 1. A decorative paper with a grammage of 105 g/m$^2$ was produced with a Fourdrinier papermaking machine. The titanium dioxide content was 30.2 g/m$^2$ (28.8 wt %) and the talc content was 8.8 g/m$^2$ (8.4 wt %). The talc had a particle size distribution D50 of 1.9 $\mu$m and a specific surface area of 44,300 m$^2$/kg.

EXAMPLE 3

A pigment mixture of 64.5 wt % titanium dioxide and 3.3 wt % talc was added to the basic mixture from Example 1. A decorative paper with a weight of 105 g/m$^2$ was produced on a Fourdrinier papermaking machine. The titanium dioxide content was 38.7 g/m$^2$ (36.5 wt %) and the talc content was 2.0 g/m$^2$ (1.9 wt %). The talc had a particle size distribution D50 of 1.9 $\mu$m and a specific surface area of 44,300 m$^2$/kg.

EXAMPLE 4

A pigment mixture of 53.9 wt % titanium dioxide and 11.3 wt % talc was added to the basic mixture from Example 1. A decorative paper with a weight of 105 g/m$^2$ was produced on a Fourdrinier papermaking machine. The titanium dioxide content was 32.3 g/m$^2$ (30.8 wt %) and the talc content was 6.8 g/m$^2$ (6.5 wt %). The talc had a particle size distribution D50 of 1.5 $\mu$m and a specific surface area of 47,100 m$^2$/kg.

Comparative Example 1

As Comparative Example 1, only a 62 wt % titanium dioxide dispersion was added to the basic mixture from Example 1. A decorative paper with a weight of 120 g/m$^2$ and a titanium dioxide content of 37.2 g/m$^2$ (31 wt %) was produced using a Fourdrinier papermaking machine.

Comparative Example 2

A pigment mixture of 50.8 wt % titanium dioxide and 14.4 wt % talc was added to the basic mixture from Example 1. A decorative paper with a weight of 105 g/m$^2$ was produced on a Fourdrinier papermaking machine. The titanium dioxide content was 30.5 g/m$^2$ (29 wt %) and the talc content was 8.7 g/m$^2$ (8.3 wt %). The talc had a particle size distribution D50 of 3.7 $\mu$m and a specific surface area of 8,600 m$^2$/kg.

The opacity of paper samples from Examples B1 through B4 and Comparative Examples V1 and V2 was determined according to DIN 53,146 by using an ACE color measuring instrument from Data Color. The titanium dioxide content of the decorative base paper was determined according to DIN 54,370. The results are summarized in the following table.

| Sample | Opacity (%) | Talc content, based on total pigment (%) | Talc content (g/m$^2$) |
|---|---|---|---|
| B1 | 92.68 | 8.5 | 3.1 |
| B2 | 92.55 | 22.6 | 8.8 |
| B3 | 92.61 | 4.9 | 2.0 |
| B4 | 92.62 | 17.3 | 6.8 |
| V1 | 92.71 | 0.0 | 0.0 |
| V2 | 90.28 | 22.2 | 8.7 |

The results of the opacity measurements show that a high opacity can be achieved with the talc used according to this invention even with a greatly reduced titanium dioxide content.

What is claimed is:

1. A decorative base paper for decorative coating materials, comprising a pigment mixture of titanium dioxide and talc, wherein the talc has a content of 0.1 to 25 wt % based on the total pigment content, and a particle size distribution D50 of less than approximately 2.0 $\mu$m, and wherein said paper has an opacity which is substantially the same as a pacer having said pigment mixture in the absence of said talc.

2. A decorative base paper according to claim 1, wherein the talc has a specific surface area of more than approximately 30,000 m$^2$/kg.

3. A decorative base paper according to claim 1, wherein the paper contains cationically modified cellulose fibers.

4. A decorative base paper according to claim 3, wherein the cellulose fibers are modified with quaternary ammonium compounds with glycidyl function.

5. A decorative paper or decorative sheet containing a decorative base paper, said base paper comprises a pigment mixture of titanium dioxide and talc, wherein the talc has a content of 0.1 to 25 wt % based on the total pigment content, and the talc has a particle size distribution D50 of less than approximately 2.0 $\mu$m, and wherein said base paper has an opacity which is substantially the same as a base paper having said pigment mixture in the absence of said talc.

* * * * *

UNITED STATES PATENT AND TRADEMARK OFFICE

CERTIFICATE OF CORRECTION

PATENT NO. : 6,783,631 B2
DATED : August 31, 2004
INVENTOR(S) : Hartmut Schulz

It is certified that error appears in the above-identified patent and that said Letters Patent is hereby corrected as shown below:

Title page,
Item [57], ABSTRACT,
Line 5, "capacity" should be -- opacity --.

Column 6,
Line 9, "pacer" should be -- paper --.

Signed and Sealed this

Seventh Day of December, 2004

JON W. DUDAS
*Director of the United States Patent and Trademark Office*